US010047528B1

(12) United States Patent
Kim

(10) Patent No.: US 10,047,528 B1
(45) Date of Patent: Aug. 14, 2018

(54) STRUCTURE FOR SUPPORTING ACCESS FLOOR PANEL

(71) Applicant: HAE KWANG CO., LTD., Jincheon-gun (KR)

(72) Inventor: Myun Soo Kim, Gwacheon-si (KR)

(73) Assignee: HAE KWANG CO., LTD., Jincheon-gun (KR)

( * ) Notice: Subject to any disclaimer, the term of this patent is extended or adjusted under 35 U.S.C. 154(b) by 0 days.

(21) Appl. No.: 15/478,633

(22) Filed: Apr. 4, 2017

(30) Foreign Application Priority Data

Feb. 10, 2017 (KR) ..... 10-2017-0018923

(51) Int. Cl.
*E04B 9/00* (2006.01)
*E04F 15/024* (2006.01)

(52) U.S. Cl.
CPC .... *E04F 15/02458* (2013.01); *E04F 15/0247* (2013.01); *E04F 15/02452* (2013.01)

(58) Field of Classification Search
CPC ... E04B 2/76; E04B 2/766; E04B 1/24; E04B 1/1903; E04B 1/19; E04B 2/762; E04B 2001/405; E04B 1/5806; E04B 2002/05; E04C 3/08; E04C 200/0439; E04C 2003/0491; E04C 2003/046; E04C 2003/0465; E04C 2003/0408; E04C 3/02; E04C 3/07; E04C 2003/0439
USPC ..... 52/126.6, 79.9, 831, 79.8, 646, 649.2, 52/649.6, 650.1, 655.1, 126.7, 126.4, 52/126.3, 126.1
See application file for complete search history.

(56) References Cited

U.S. PATENT DOCUMENTS 3,893,271 A * 7/1975 Kotlarz ..... E04B 1/24 52/168
5,263,296 A * 11/1993 Spera ..... E04G 7/26 182/186.8
5,412,914 A * 5/1995 Daw ..... E04B 1/19 52/126.6
7,779,599 B2 * 8/2010 Jolicoeur ..... E01D 19/106 182/150
2001/0054269 A1 * 12/2001 Miller, Jr. ..... E04B 1/0046 52/632
2002/0170240 A1 * 11/2002 Thompson ..... E04B 2/7453 52/36.1
2003/0163958 A1 * 9/2003 Zeh ..... A47B 83/001 52/36.5

(Continued)

FOREIGN PATENT DOCUMENTS

KR 101293433 B1 8/2013

*Primary Examiner* — Chi Q Nguyen
(74) *Attorney, Agent, or Firm* — Perkins Coie LLP

(57) ABSTRACT

Disclosed herein is a structure for supporting an access floor panel, which includes a plurality of X-axis beams arranged to be spaced apart in an X-axis direction, each having an X-axis guide groove formed on a center of an upper surface thereof in the X-axis direction, a plurality of Y-axis beams arranged to be spaced apart in a Y-axis direction at the same height as the X-axis beams, each having a Y-axis guide groove formed on a center of an upper surface thereof in the Y-axis direction, a post configured to have a post head and support each of the X-axis beams and an associated one of the Y-axis beams, and a connection bracket configured to fix each of the X-axis beams and an associated one of the Y-axis beams to the post head.

13 Claims, 8 Drawing Sheets

(56) References Cited

U.S. PATENT DOCUMENTS

| | | | | |
|---|---|---|---|---|
| 2007/0175132 | A1* | 8/2007 | Spransy | E04F 15/02405 52/263 |
| 2008/0110127 | A1* | 5/2008 | Terada | E04L 32/7435 52/646 |
| 2009/0056253 | A1* | 3/2009 | Davis | E02D 27/16 52/292 |
| 2012/0216475 | A1* | 8/2012 | Safari Kermanshahi | E04C 3/086 52/309.4 |
| 2012/0216479 | A1* | 8/2012 | Lewcock | E04B 1/24 52/588.1 |

* cited by examiner

STRUCTURE FOR SUPPORTING ACCESS FLOOR PANEL

CROSS-REFERENCE TO RELATED APPLICATIONS

This patent document claims priority to Korean Patent Application No. 10-2017-0018923, filed on Feb. 10, 2017, the disclosure of which is incorporated herein by reference in its entirety.

BACKGROUND OF THE INVENTION

Field of the Invention

Exemplary embodiments of the present invention relate to an access floor system, and more particularly, to a structure for supporting an access floor panel for example in a clean room.

Description of the Related Art

In general, advanced special equipment, which is very sensitive to fine dust, dust particles, or the like introduced from the outside or by operators, is installed in a clean room, such as a semiconductor manufacturing room for manufacturing semiconductors that require a high precision and integration, a pharmaceutical laboratory, or a genetic engineering laboratory.

For this reason, an access floor system is installed on the floor of the clean room in order to effectively absorb and remove fine dust, dust particles, or the like introduced into the clean room from the outside, to prevent cracking or sinking from occurring by evenly dispersing concentrated loads applied to the floor of the clean room from the advanced special equipment, and to place a variety of cables and exhaust ducts related to the advanced special equipment.

The access floor system includes a foundation of the clean room, a floor panel that is installed at a certain height from the foundation and has a large number of vent holes through which contaminated air in the clean room is discharged to the outside, and a structure interposed between the foundation and the floor panel to allow the floor panel to be installed in the state in which it is spaced apart from the foundation by a predetermined height.

The loads applied to the structure from the floor panel after the installation of the structure are a static load and a dynamic load, and they act on the structure as stress such as an axial load and a one-sided load, in which case the fragile portions of the structure are sheared and damaged in the conditions of an excessive load rating or stress being suddenly applied, e.g. an earthquake.

SUMMARY OF THE INVENTION

An object of the present invention is to provide a structure for supporting an access floor panel, in which X-axis and Y-axis beams have the same height in order to install smoothly dust removal frames for strengthening a floor of a region where heavy weights move for circulation thereof, and/or for installing equipment.

Another object of the present invention is to provide a structure for supporting an access floor panel, in which it is possible to minimize an influence on the structure by securing safety against load and vibration of the structure.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an aspect of the present invention, a structure for supporting an access floor panel, a floor panel being seated on the structure, includes a plurality of X-axis beams arranged to be spaced apart in an X-axis direction, each having an X-axis guide groove formed on a center of an upper surface thereof in the X-axis direction, a plurality of Y-axis beams arranged to be spaced apart in a Y-axis direction at the same height as the X-axis beams, each having a Y-axis guide groove formed on a center of an upper surface thereof in the Y-axis direction, a post configured to have a post head and support each of the X-axis beams and an associated one of the Y-axis beams, and a connection bracket configured to fix each of the X-axis beams and an associated one of the Y-axis beams to the post head.

Each of the Y-axis beams may have outer flanges protruding outward from both sides of a lower end thereof.

Each of the X-axis and Y-axis beams may have inner flanges protruding inward from both sides of a lower end thereof.

The post may include a base plate fixedly anchored on the ground, a post column coupled on the base plate, and the post head installed above the post column to support the X-axis or Y-axis beam.

The structure may further include a post cap coupled on the post column.

The structure may further include a screw shaft fixed beneath the post head, and an adjustable nut disposed above the post column to be coupled to the screw shaft.

The connection bracket may include a bottom plate disposed on an upper surface of the post head and coupled to the Y-axis beam by a first fixing member, and a side plate bent upward from an inner end of the bottom plate and coupled to the X-axis beam by a second fixing member.

The X-axis beam may have a slide groove that is longitudinally formed on a side thereof, and the side plate may have a guide rib protruding from an upper end thereof, so that the guide rib is inserted into and coupled to the slide groove to thereby guide coupling of the X-axis beam.

The structure may further include a sub-Y-axis beam disposed to face the Y-axis beam with the X-axis beam interposed therebetween.

The structure may further include a seating pad coupled on each of the X-axis beams and an associated one of the Y-axis beams, and the seating pad may have at least one seating rib protruding upward from an upper surface thereof to seat the floor panel thereon.

The seating pad may be coupled on an intersection of the X-axis and Y-axis beams.

The seating ribs may be arranged in a cross form on the seating pad.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

Figure 1:
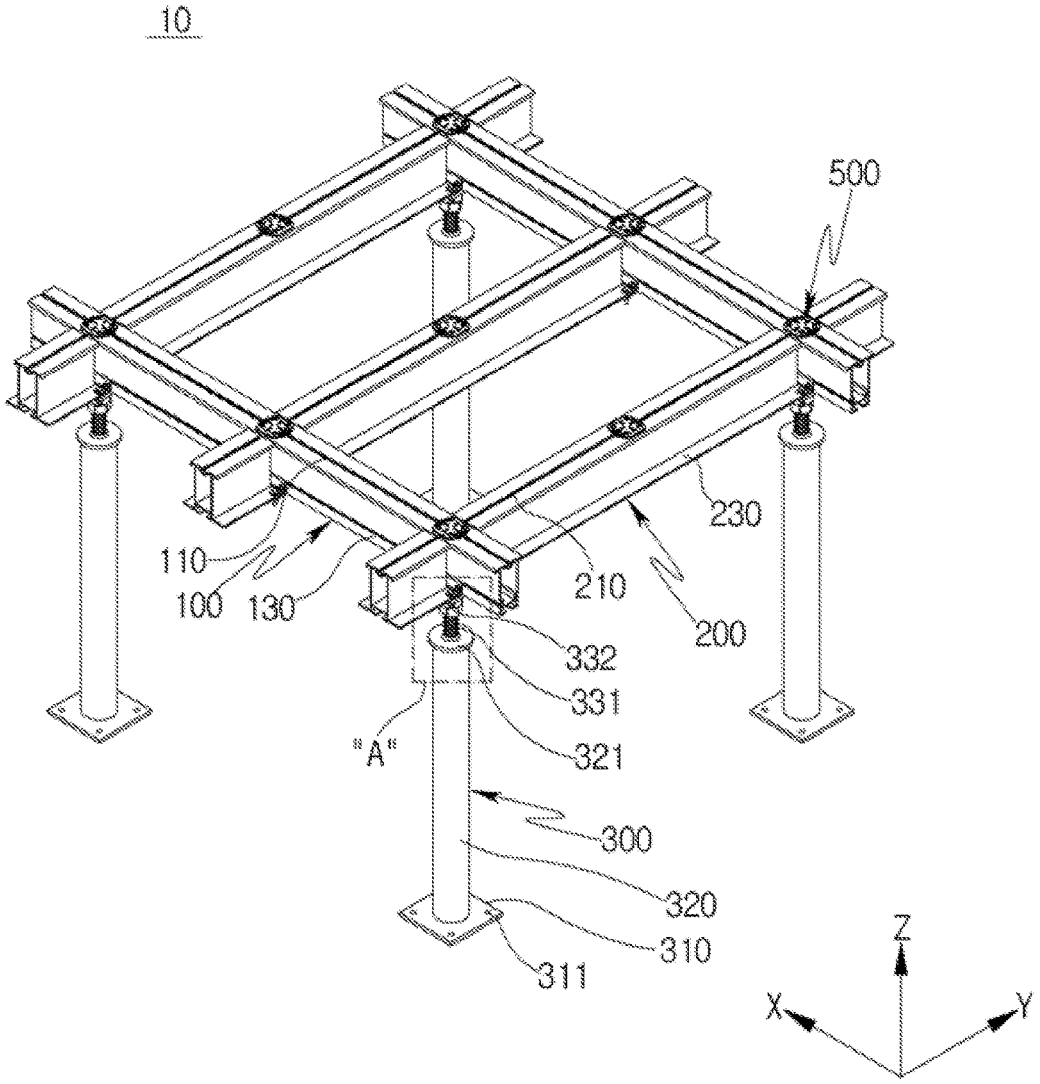
FIG. 1 is a perspective view illustrating a structure for supporting an access floor panel according to an embodiment of the present invention.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

In the whole description, it will be understood that when an element is referred to as being "connected" to another element, it can be "directly connected" to the other element or it can be "electrically connected" to the other element with other elements being interposed therebetween. In addition, it will be understood that when a component is referred to as being "comprising" any component, it does not exclude other components, but can further comprises the other components unless otherwise specified.

Hereinafter, exemplary embodiments of the present invention will be described in detail with reference to the accompanying drawings.

Figure 2:
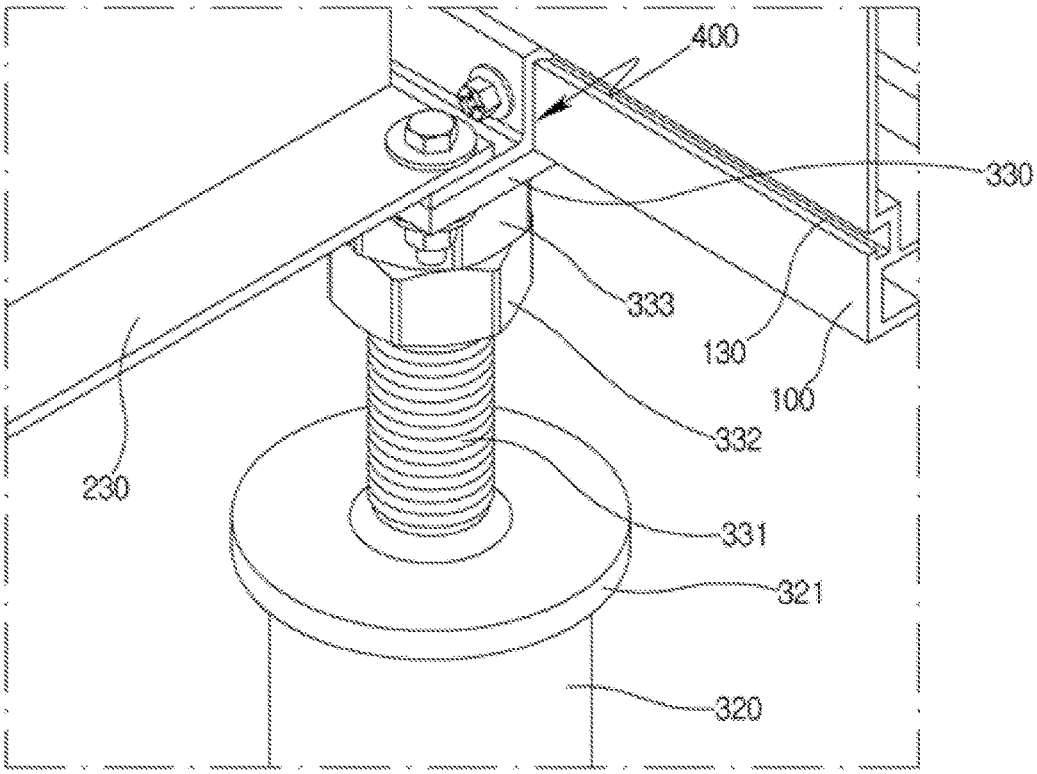
FIG. 2 is an expanded perspective view illustrating portion "A" of FIG. 1.

FIG. 1 is a perspective view illustrating a structure for supporting an access floor panel according to an embodiment of the present invention. FIG. 2 is an expanded perspective view illustrating portion "A" of FIG. 1.

Referring to FIGS. 1 and 2, the structure for supporting an access floor panel, which is designated by reference numeral 10, according to the embodiment of the present invention includes a plurality of X-axis beams 100 and a plurality of Y-axis beams 200 which are orthogonally coupled to each other.

The X-axis beams 100 are arranged to be spaced at regular intervals in an X-axis direction in parallel to each other, and the Y-axis beams 200 are arranged to be spaced at regular intervals in a Y-axis direction in parallel to each other. The arrangement distance between the X-axis beams 100 and the arrangement distance between the Y-axis beams 200 may respectively correspond to, for example, a length (or width) and a width (or length) of one floor panel.

Each of the X-axis beams 100 and the Y-axis beams 200 has an elongated guide groove that is longitudinally formed on the center of the upper surface thereof. That is, the X-axis beam 100 has an elongated X-axis guide groove 110 formed on the center of the upper surface thereof in the X-axis direction, and the Y-axis beam 200 has an elongated Y-axis guide groove 210 formed on the center of the upper surface thereof in the Y-axis direction. The guide grooves may guide movement of seating pads 500 at the time of installation of the seating pad 500, which will be described later. In addition, each of the Y-axis beams 200 has outer flanges 230 that are formed at the lower end thereof while extending outward in the width direction thereof, for fastening of a connection bracket 400 to a post head 330 which will be described later.

Although the X-axis beams 100 and the Y-axis beams 200 are each formed of a hollow body with a square cross section in the embodiment, the present invention is not limited thereto. For example, H-section steels, L-section steels, and/or section steels with polygonal cross sections may be used as the X-axis beams 100 and the Y-axis beams 200.

An end cap (not shown) may be coupled to the end of each of the X-axis beams 100 and the Y-axis beams 200 so as to prevent moisture or foreign substances from being introduced into the beam.

A plurality of posts 300 is vertically installed beneath contact portions of the X-axis beams 100 with the Y-axis beams 200 to support the beams, respectively. Each of the posts 300 is manufactured to have a length corresponding to the design height h of the floor panel in the access floor structure.

Figure 3:
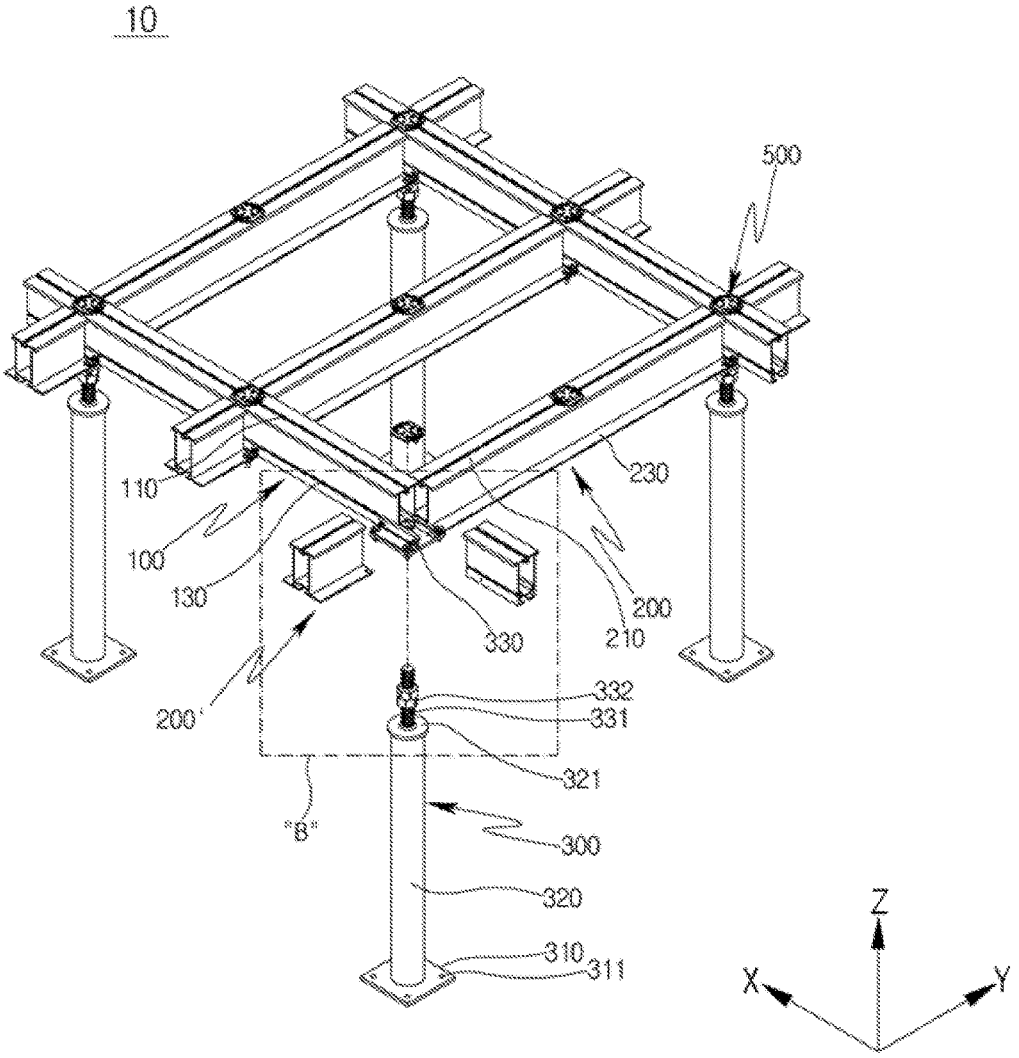
FIG. 3 is an exploded perspective view illustrating the structure for supporting an access floor panel according to the embodiment of the present invention.
Figure 4:
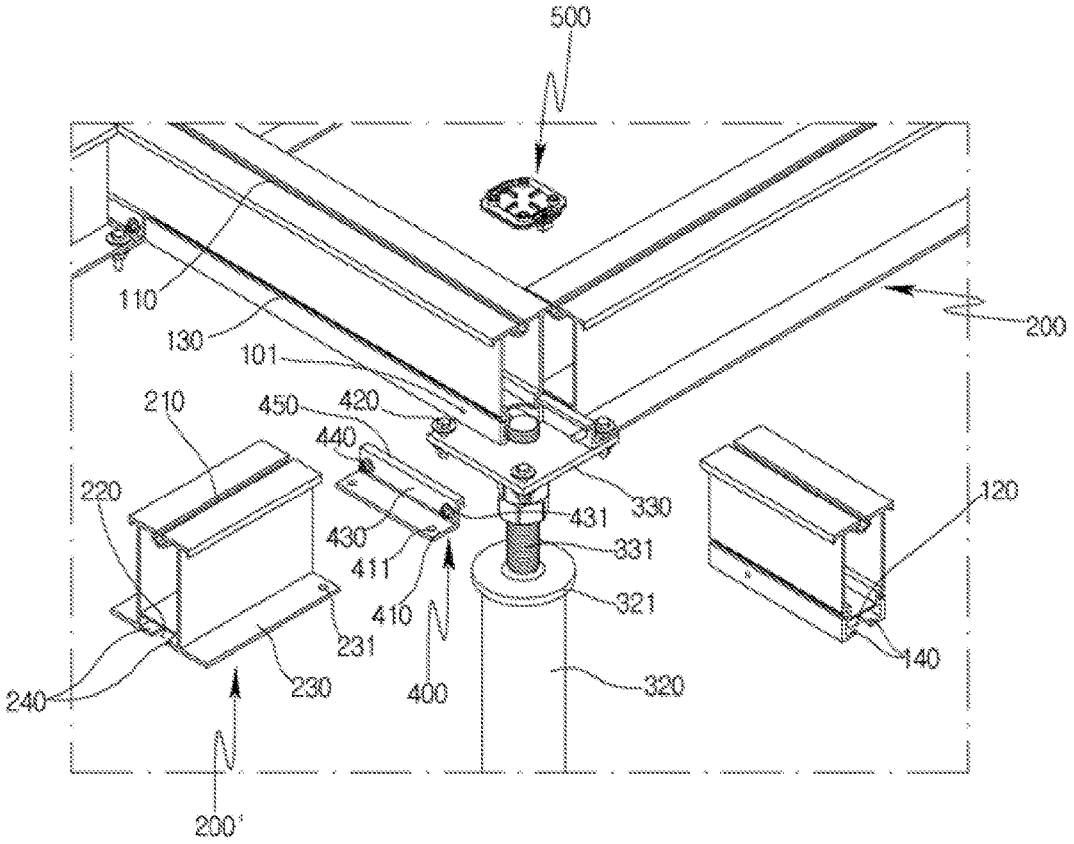
FIG. 4 is an expanded perspective view illustrating portion "B" of FIG. 3.

FIG. 3 is an exploded perspective view illustrating the structure for supporting an access floor panel according to the embodiment of the present invention. FIG. 4 is an expanded perspective view illustrating portion "B" of FIG. 3.

Referring to FIGS. 3 and 4, each of the posts 300 used in the embodiment includes a base plate 310, a post column 320, and a post head 330, and is vertically installed beneath an associated one of the contact portions of the X-axis beams 100 with the Y-axis beams 200 to stably support the floor panel.

The base plate 310 has a flat shape to be anchored on the ground, and has a plurality of anchor holes 311 to be anchored on the ground by anchor bolts or the like.

The post column 320 is coupled on the base plate 310, and is formed of a hollow body to be coupled with the post head 330. A post cap 321 may be provided to the upper end of the post column 320 to prevent foreign substances from being introduced into the post column 320 and dispose an adjustable nut 332 to be described later thereon.

Although the post column 320 has a cylindrical shape in the embodiment, the present invention is not limited thereto as long as the post column 320 has strength for supporting the access floor panel. For example, the post column 320 may have a polygonal column shape that has a triangular or square cross section, as necessary.

The post head 330 has a square flat shape to come into tight contact with the bottom of the associated X-axis or Y-axis beam 100 or 200, and is coupled through the medium of a screw shaft 331 on the post column 320 such that the height of the post head 330 is adjustable up and down.

That is, the screw shaft 331 has a thread formed on the outer peripheral surface thereof, and one end of the screw shaft 331 is inserted into and coupled to the center of the post head 330 while the other end thereof is fixedly coupled to the post cap 321. In this case, the adjustable nut 332 may be screwed on the outer peripheral surface of the screw shaft 331 beneath the post head 330 so as to adjust the height of the post head 330, and a washer 333 may be disposed on the adjustable nut 332 to increase clamping force. Accordingly, the post head 330 supported by the adjustable nut 332 moves up or down when the adjustable nut 332 is turned clockwise or counterclockwise about the screw shaft 331, thereby enabling the overall height of the floor panel to be easily adjusted.

The connection bracket 400 is coupled to the upper surface of the post head 330 to fix the associated X-axis and Y-axis beams 100 and 200 to the post head 330. The connection bracket 400 includes a bottom plate 410 that is tightly disposed on the upper surface of the post head 330 to be coupled to the Y-axis beam 200 by first fixing members 420, and a side plate 430 that is bent upward from the inner end of the bottom plate 410 to be coupled to the X-axis beam 100 by second fixing members 440.

The bottom plate 410 has one or more screw holes 411 formed in a Z-axis direction, and the outer flanges 230 of the Y-axis beam 200 have screw holes 231 formed in the Z-axis direction so as to correspond to the screw holes 411. The first fixing members 420 are inserted into and coupled to the screw holes 411 and 231.

The side plate 430 has one or more screw holes 431 formed on the surface thereof in the Y-axis direction, and the X-axis beam 100 has screw holes 101 formed in the Y-axis direction so as to correspond to the screw holes 431. The second fixing members 440 are inserted into and coupled to the screw holes 431 and 101 so that the side plate 430 is fixed to the X-axis beam 100.

The side plate 430 has a guide rib 450 that is bent and extends from the upper end thereof toward the X-axis beam 100 to guide the assembly of the X-axis beam 100. That is, the X-axis beam 100 has a slide groove 130 that is longitudinally formed on the side thereof, and the guide rib 450, which protrudes from the upper end of the side plate 430, is inserted into and coupled to the slide groove 130, thereby guiding the coupling of the X-axis beam 100.

The connection bracket 400 may consist of a pair of connection brackets that are symmetrically disposed about the screw shaft 331 protruding upward from the post head 330. Sub-Y-axis beams 200' may be provided outside the X-axis beams 100 in the width direction thereof so as to face the Y-axis beams 200 with the X-axis beams 100 interposed therebetween. That is, the end of each of the Y-axis beams 200 and the end of the associated one of the sub-Y-axis beams 200' may be tightly disposed at both sides of the associated X-axis beam 100. Since the sub-Y-axis beams 200' have the same structure as the Y-axis beams 200, detailed description will be omitted.

Each of the X-axis beams 100 and each of the Y-axis beams 200 have spaces 120 and 220 that are defined in the respective lower portions thereof so as not to interfere with the upper end of the screw shaft 331, which protrudes upward from the associated post head 330, during the assembly of the structure for supporting an access floor panel. The X-axis beam 100 and the Y-axis beam 200 have inner flanges 140 and 240 that are respectively formed at the lower ends thereof while extending inward in the width direction of the Y-axis beam 200 so as to come into contact with the screw shaft 331. As a result, it is possible to prevent the X-axis beam 100 and the Y-axis beam 200 from moving on the post head.

Figure 5:
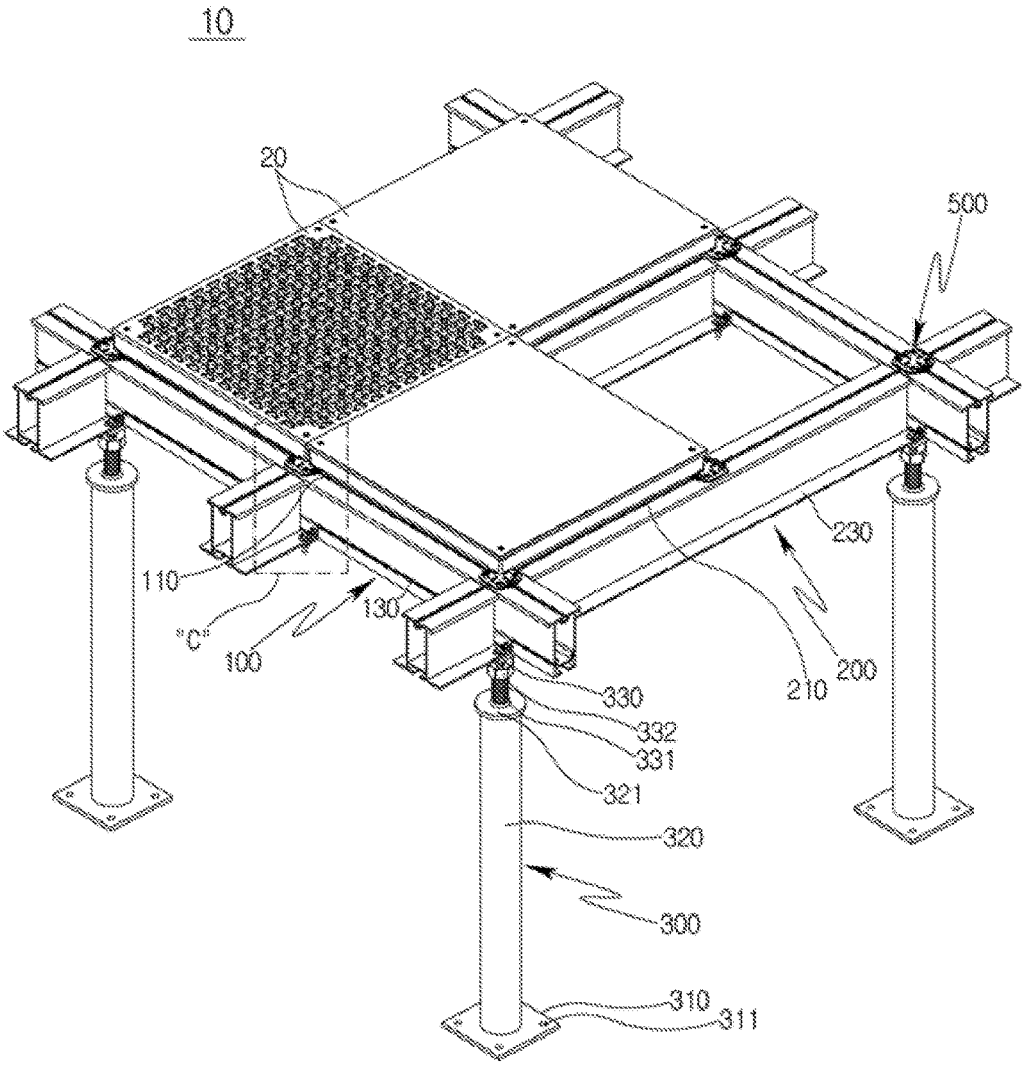
FIG. 5 is a perspective view illustrating a state in which floor panels are installed on the structure for supporting an access floor panel according to the embodiment of the present invention.
Figure 6:
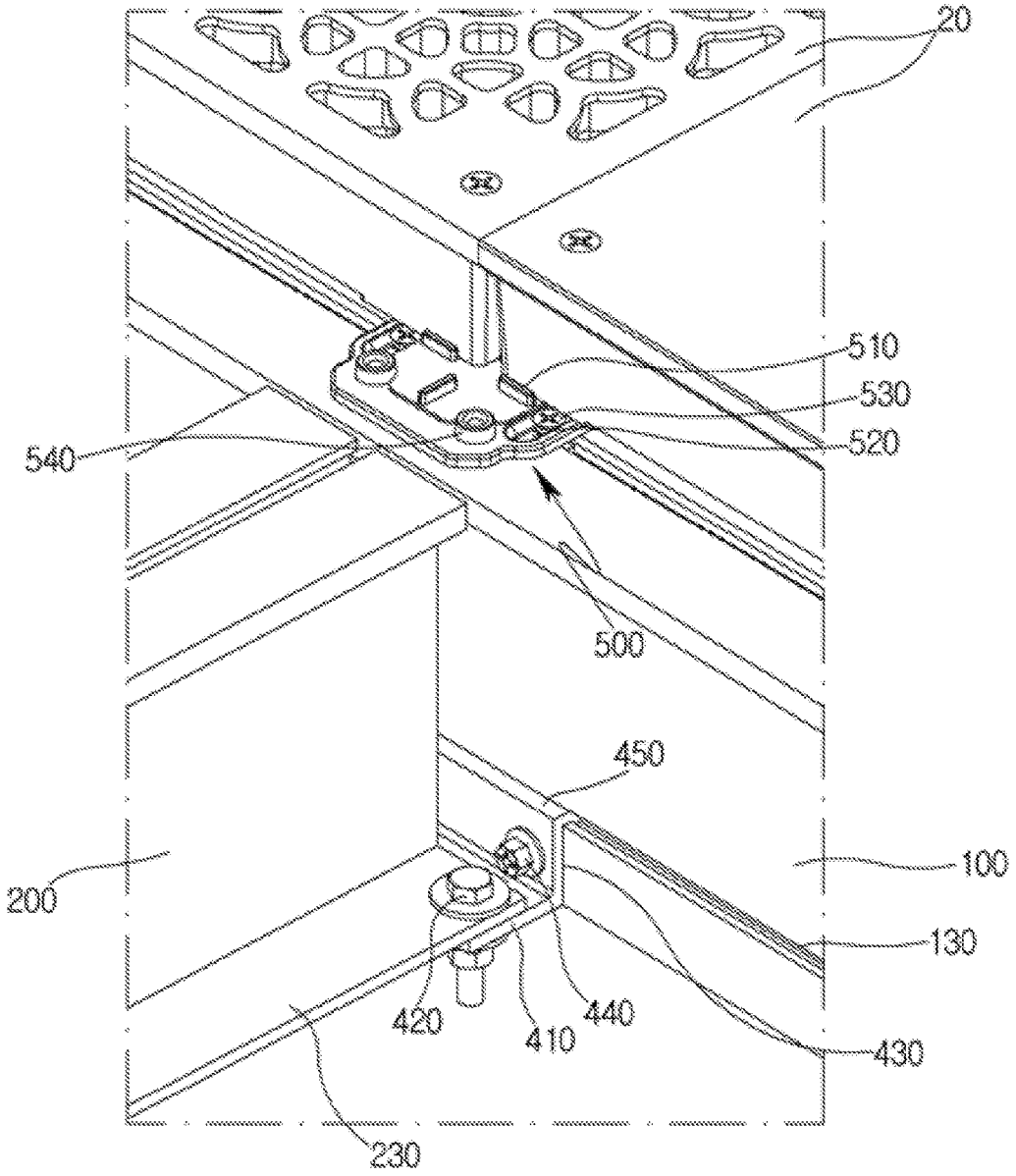
FIG. 6 is an expanded perspective view illustrating portion "C" of FIG. 5.
Figure 7:
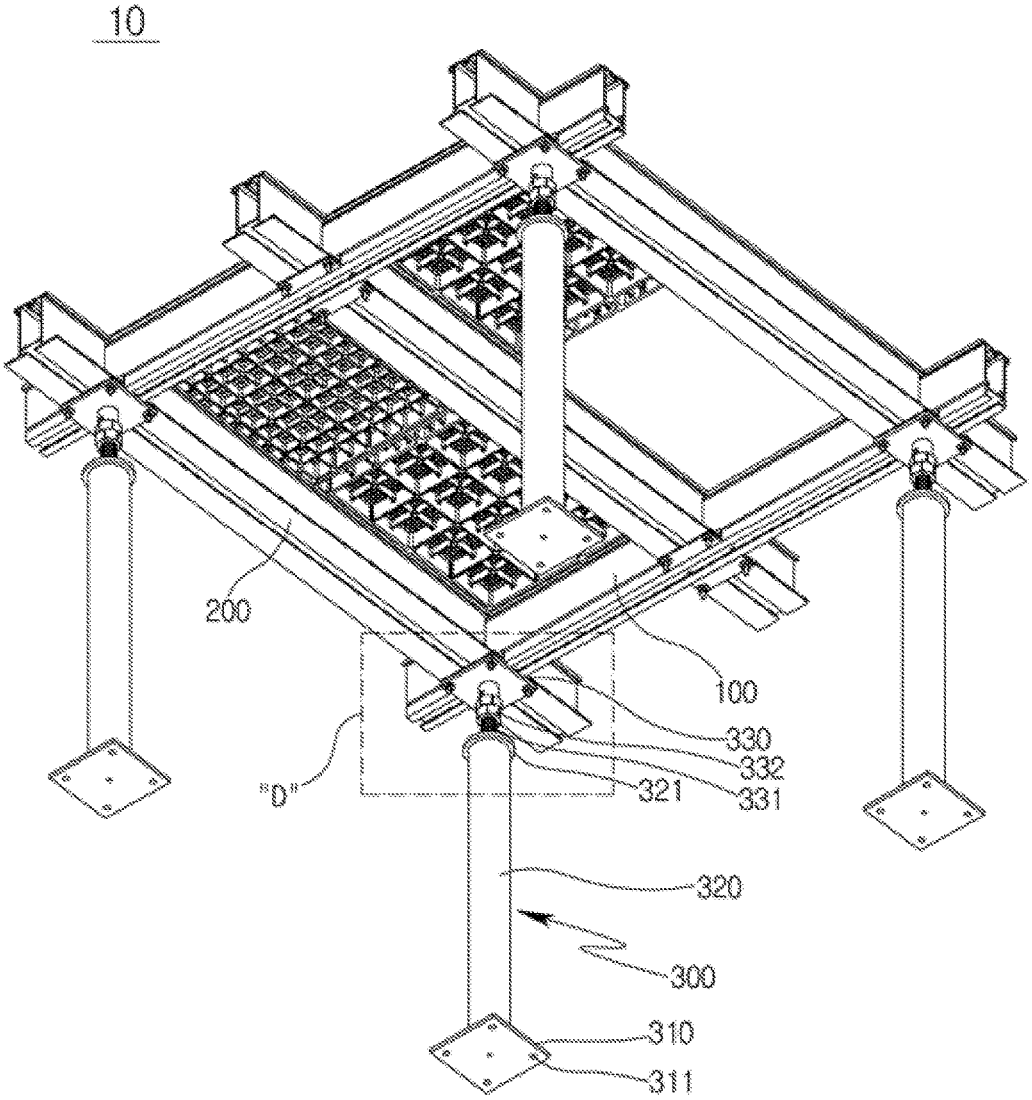
FIG. 7 is a perspective view illustrating the structure for supporting an access floor panel according to the embodiment of the present invention when viewed from another angle.
Figure 8:
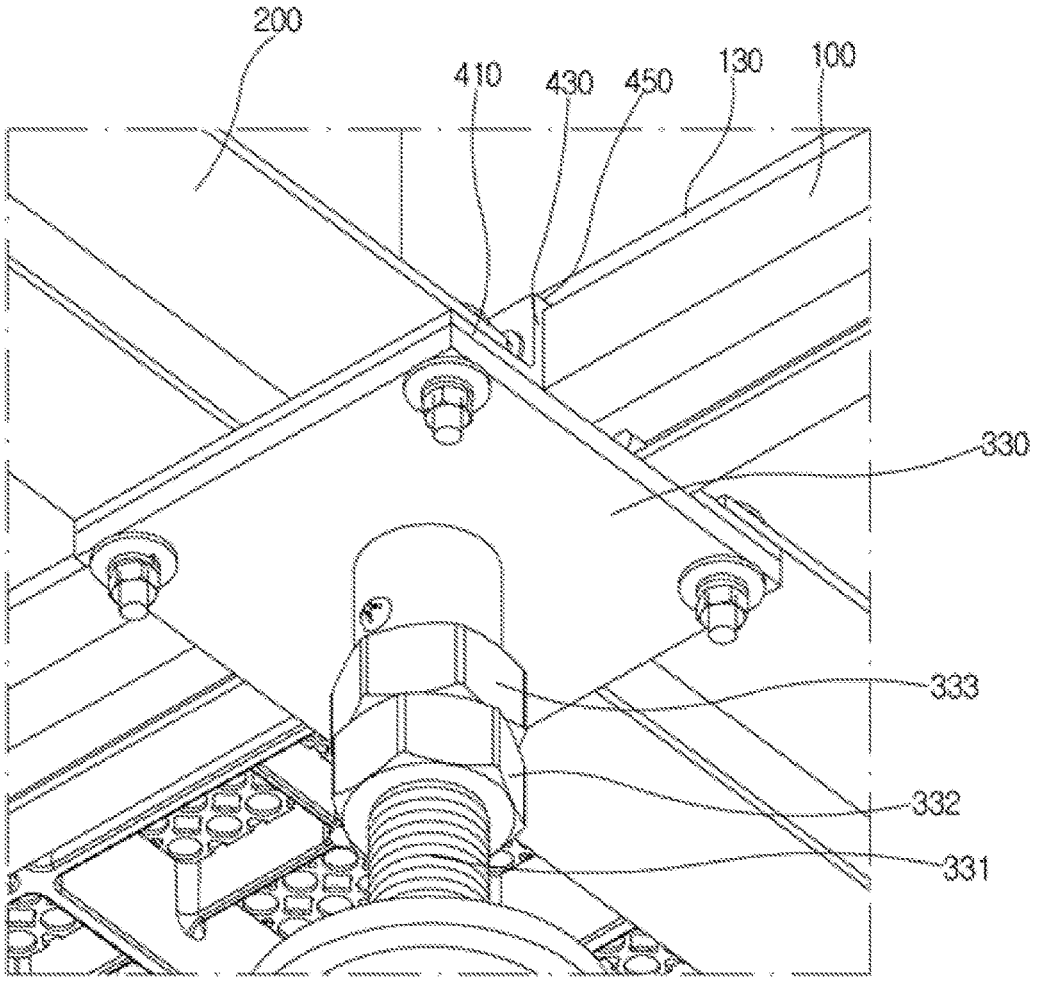
FIG. 8 is an expanded perspective view illustrating portion "D" of FIG. 7.

FIG. 5 is a perspective view illustrating a state in which floor panels are installed on the structure for supporting an access floor panel according to the embodiment of the present invention. FIG. 6 is an expanded perspective view illustrating portion "C" of FIG. 5. FIG. 7 is a perspective view illustrating the structure for supporting an access floor panel according to the embodiment of the present invention when viewed from another angle. FIG. 8 is an expanded perspective view illustrating portion "D" of FIG. 7.

Referring to FIGS. 5 to 8, a plurality of floor panels 20 is installed on the structure for supporting an access floor panel, and a plurality of seating pads 500 is coupled on the X-axis and Y-axis beams 100 and 200 to seat the floor panels 20 thereon. Particularly, it is necessary to couple the seating pads on intersections of the X-axis and Y-axis beams 100 and 200, and the seating pads may be further installed on the X-axis and Y-axis guide grooves 110 and 210 of the X-axis and Y-axis beams 100 and 200 as necessary.

The seating pads 500 each have at least one seating rib 510 that protrudes upward from the upper surface thereof to seat the floor panels 20 thereon. The seating rib 510 protrudes from the surface of the seating pad 500 to divide the upper surface of the seating pad 500 into at least two sections, thereby allowing the floor panels 20 to be settled in the sections. The seating ribs 510 may be arranged in a substantially cross (+) form on the seating pad 500 when viewed from the top, and the central portion between the seating ribs 510 may be formed as a vacant space where they are not in contact with each other.

The seating pad 500 may have fastening holes 520 formed at both sides thereof in the X-axis direction, and the fastening holes 520 are fixed to the X-axis guide groove 110 of the associated X-axis beam 100 by fastening pins 530. In addition, the seating pad 500 may have fastening bosses 540 that are formed on the upper surface thereof while protruding upward at positions that do not interfere with the seating rib 510 and the fastening holes 520, so as to guide the fixing of the floor panels 20.

As described above, when the X-axis and Y-axis beams 100 and 200 are orthogonally installed to intersect with each other, it is possible to improve resistance against vibration or lateral force applied in a direction orthogonal to the installation direction of the beams, compared to a structure in which beams are arranged only in one direction. In addition, since the X-axis and Y-axis beams 100 and 200 are installed to intersect with each other at the same level (height), it is possible to further increase resistance against lateral load and vibration.

As is apparent from the above description, according to exemplary embodiments of the present invention, since X-axis and Y-axis beams are installed at the same height, it is possible to install easily dust removal frames for strengthening a floor panel of a portion where heavy weights move for circulation thereof, and/or for installing equipment.

In addition, since the X-axis and Y-axis beams are orthogonally installed to intersect with each other at the same height, it is possible to minimize deformation of a structure by securing safety against load and vibration applied to the structure.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

While the present invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A structure for supporting an access floor panel, a floor panel being seated on the structure, the structure comprising:

a plurality of X-axis beams arranged to be spaced apart in an X-axis direction, each of said plurality of x-axis beams having an X-axis guide groove formed on a center of an upper surface thereof in the X-axis direction;

a plurality of Y-axis beams arranged to be spaced apart in a Y-axis direction at the same height as the X-axis beams, each of said plurality of y-axis beams having a Y-axis guide groove formed on a center of an upper surface thereof in the Y-axis direction;

a post configured to have a post head and support each of the X-axis beams and an associated one of the Y-axis beams; and a connection bracket configured to fix each of the X-axis beams and an associated one of the Y-axis beams to the post head;

wherein the connection bracket comprises:

a bottom plate disposed on an upper surface of the post head and coupled to the Y-axis beam by a first fixing member; and a side plate bent upward from an inner end of the bottom plate and coupled to the X-axis beam by a second fixing member, wherein the X-axis beam has a slide groove that is longitudinally formed on a side thereof, and the side plate has a guide rib protruding from an upper end thereof, so that the guide rib is inserted into and coupled to the slide groove to thereby guide coupling of the X-axis beam.

2. The structure according to claim 1, wherein each of the Y-axis beams has outer flanges protruding outward from both sides of a lower end thereof.

3. The structure according to claim 1, wherein each of the X-axis and Y-axis beams has inner flanges protruding inward from both sides of a lower end thereof.

4. The structure according to claim 1, wherein the post comprises:

a base plate fixedly anchored on the ground;

a post column coupled on the base plate; and the post head installed above the post column to support the X-axis or Y-axis beam.

5. The structure according to claim 4, further comprising a post cap coupled on the post column.

6. The structure according to claim 4, further comprising a screw shaft fixed beneath the post head, and an adjustable nut disposed above the post column to be coupled to the screw shaft.

7. The structure according to claim 1, further comprising a sub-Y-axis beam disposed to face the Y-axis beam with the X-axis beam interposed therebetween.

8. The structure according to claim 1, further comprising a seating pad coupled on each of the X-axis beams and an associated one of the Y-axis beams, and the seating pad has at least one seating rib protruding upward from an upper surface thereof to seat the floor panel thereon.

9. The structure according to claim 8, wherein the seating pad is coupled on an intersection of the X-axis and Y-axis beams.

10. The structure according to claim 8, wherein the seating ribs are arranged in a cross form on the seating pad.

11. A structure for supporting an access floor panel, a floor panel being seated on the structure, the structure comprising:

a plurality of X-axis beams arranged to be spaced apart in an X-axis direction, each of said plurality of x-axis beams having an X-axis guide groove formed on a center of an upper surface thereof in the X-axis direction;

a plurality of Y-axis beams arranged to be spaced apart in a Y-axis direction at the same height as the X-axis beams, each of said plurality of y-axis beams having a Y-axis guide groove formed on a center of an upper surface thereof in the Y-axis direction;

a post configured to have a post head and support each of the X-axis beams and an associated one of the Y-axis beams; and a connection bracket configured to fix each of the X-axis beams and an associated one of the Y-axis beams to the post head, wherein the structure further comprises a seating pad coupled on each of the X-axis beams and an associated one of the Y-axis beams, and the seating pad has at least one seating rib protruding upward from an upper surface thereof to seat the floor panel thereon.

12. The structure according to claim 11, wherein the seating pad is coupled on an intersection of the X-axis and Y-axis beams.

13. The structure according to claim 11, wherein the seating ribs are arranged in a cross form on the seating pad.

* * * * *